US010329847B2

(12) United States Patent
Matthews

(10) Patent No.: US 10,329,847 B2
(45) Date of Patent: Jun. 25, 2019

(54) CUTTING ELEMENTS FOR DOWNHOLE CUTTING TOOLS

(71) Applicant: Ulterra Drilling Technologies, L.P., Fort Worth, TX (US)

(72) Inventor: Ryan K. Matthews, Fort Worth, TX (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 158 days.

(21) Appl. No.: 15/195,658

(22) Filed: Jun. 28, 2016

(65) Prior Publication Data

US 2016/0376847 A1 Dec. 29, 2016

Related U.S. Application Data

(60) Provisional application No. 62/185,783, filed on Jun. 29, 2015.

(51) Int. Cl.
*E21B 10/567* (2006.01)
*E21B 10/43* (2006.01)

(52) U.S. Cl.
CPC ..... *E21B 10/5673* (2013.01); *E21B 10/43* (2013.01)

(58) Field of Classification Search
CPC .... E21B 10/5673; E21B 10/43; E21B 10/561; E21B 10/562; E21B 10/567
See application file for complete search history.

(56) References Cited

U.S. PATENT DOCUMENTS

| | | | | |
|---|---|---|---|---|
| 4,440,246 | A * | 4/1984 | Jurgens | E21B 10/58 175/430 |
| 5,971,087 | A * | 10/1999 | Chaves | E21B 10/5735 175/426 |
| 6,604,588 | B2 * | 8/2003 | Eyre | E21B 10/5673 175/374 |
| 8,061,456 | B2 * | 11/2011 | Patel | E21B 10/5673 175/430 |
| 9,038,752 | B2 * | 5/2015 | Knull | E21B 10/55 175/431 |
| 2002/0084112 | A1 * | 7/2002 | Hall | E21B 10/5673 175/426 |
| 2006/0157286 | A1 * | 7/2006 | Pope | E21B 10/567 175/374 |
| 2010/0155149 | A1 * | 6/2010 | Keshavan | C22C 26/00 175/428 |
| 2016/0229006 | A1 * | 8/2016 | Smith | E21B 10/567 |
| 2017/0081921 | A1 * | 3/2017 | Evans | E21B 10/43 |

* cited by examiner

*Primary Examiner* — Michael R Wills, III
(74) *Attorney, Agent, or Firm* — Kilpatrick Townsend & Stockton LLP

(57) ABSTRACT

A cutter for a downhole bit includes a first face oriented in the direction of rotation of the bit and a second face oriented toward the borehole wall. A substrate supports the first face and second face and the substrate is received in a recess of the bit.

27 Claims, 2 Drawing Sheets

CUTTING ELEMENTS FOR DOWNHOLE CUTTING TOOLS

FIELD OF INVENTION

The invention relates to cutting elements used in a downhole cutting tool (such as a drag bit or the like) for advancing a borehole.

BACKGROUND

Drill bits are used as part of a drill string to advance a borehole in the earth. The drill string is rotated from the topside of the operation or by a downhole motor or both. As the bit is rotated, discrete cutting elements ("cutters") on the face of the bit fail rock at the surface of the borehole with the cutters scraping or shearing the formation. Each cutter of a rotary drag bit is positioned and oriented on a face of the drag bit to engage the earth formation of the borehole as the bit is being rotated. The cutters are typically installed on a blade of the bit with each cutter in a recess of the blade.

Drilling fluid is pumped down the drill string, into a central passageway formed in the center of the bit, and then out through nozzles in the face of the bit. The drill fluid cools the cutters and helps to remove and carry cuttings from the junk slots between the blades.

A typical cutter is cylindrical with a forward working surface that contacts and fails the rock of the borehole. The typical cutter can be made from a layer of polycrystalline diamond ("PCD") in the form of a polycrystalline diamond compact ("PDC") mounted to a substrate. A common substrate is cemented tungsten carbide. The substrate, while not as hard, is tougher than the PDC, and thus has higher impact resistance.

The cutter is made by mixing the polycrystalline diamond in powder form with one or more powdered metal catalysts and other materials in a mold the proximate shape of the finished cutter. The mold and raw materials are consolidated using extreme heat and pressure. Cobalt or an alloy of cobalt is the most common catalyst included in the substrate material. During processing, the cobalt infiltrates the diamond crystals and act as a catalyst to form diamond-to-diamond bonds between adjacent diamond grains to create an ultrahard cutting face to engage the rock.

The blades of a bit can extend from the nose portion over a shoulder portion of the bit. Cutters can be mounted on the leading edge of a blade of the bit and create a cutting profile of the bit. In general, the nose cutters advance the borehole and the shoulder cutters widen the borehole. Above this shoulder section is the gage section which can receive cutters and/or gaging inserts. The inserts prevent the body of the bit, which is typically softer than the PDC cutters, from contacting the borehole and being abraded or eroded by the contact. The gage inserts are generally mounted to the body of the bit or a radial face of the blade. The gage inserts can be mounted behind cutters in the gage section. The cutters and inserts limit erosive contact and maintain a nominal diameter of the bit body. The inserts can be tungsten carbide similar to the substrates of the cutters and are referred to as TCIs or tungsten carbide inserts.

Customized cutters are often mounted in the gage section and/or shoulder of the bit. These cutters are configured to have limited engagement with the borehole while maintaining the ability to fail portions of rock. These are usually cylindrical cutters that are trimmed or shaped to remove portions of the cutter table and substrate. Trimming brittle and hard diamond tables can result in cracking of the table making the cutter unusable and incurring substantial cost.

SUMMARY

This invention is related to an innovative cutter that combines the functions and features of cutters and tungsten carbide inserts for use in downhole tools. These cutters, called hybrid cutters in this application, can provide for more efficient operation of the tool. The hybrid cutter can be used on drag bits, coring bits, eccentric reamers, expandable reamers and other kinds of downhole cutting tools.

In one example, a cutter for a downhole cutting tool (e.g., a drag bit) comprises an ultrahard cutter face oriented generally in the direction of rotation of the tool, and an ultrahard gage face oriented generally in a radial direction. A base supports the ultrahard cutter and gage faces and is received in a recess of the tool.

In another example, a cutter for a downhole cutting tool includes a front ultrahard table (e.g., polycrystalline diamond (PCD)), an outer ultrahard table (e.g., PCD), and a base with a first interface to the front table and a second interface to the outer table generally orthogonal to the first interface and side surfaces connecting the front table and outer table.

In one other example, a cutter for a downhole cutting tool (e.g., a drag bit) comprises an ultrahard cutter surface facing generally forward, an ultrahard gage face facing generally outward, and an ultrahard transition face connecting the cutter face and gage face. A base supports the ultrahard cutter and gage faces and includes a pair of spaced generally planar surfaces adjacent the gage face and transition face.

In another example, a cutter for a downhole cutting tool (e.g., drag bit) includes an ultrahard surface defining a first curved portion with a radius of curvature about a first axis, and a base defining a second curved portion with a radius of curvature about a second axis generally perpendicular to and spaced from the first axis.

In some embodiments of the invention, the ultrahard surfaces are diamond compacts and the substrate is a tungsten carbide structure. In some embodiments the forward surface and the outer surface are generally orthogonal. In some embodiments, the substrate includes outer faces adjacent the outer ultrahard surface joined by a curved surface adjacent the forward surface.

DETAILED DESCRIPTION OF EXEMPLARY EMBODIMENTS

Figure 1:
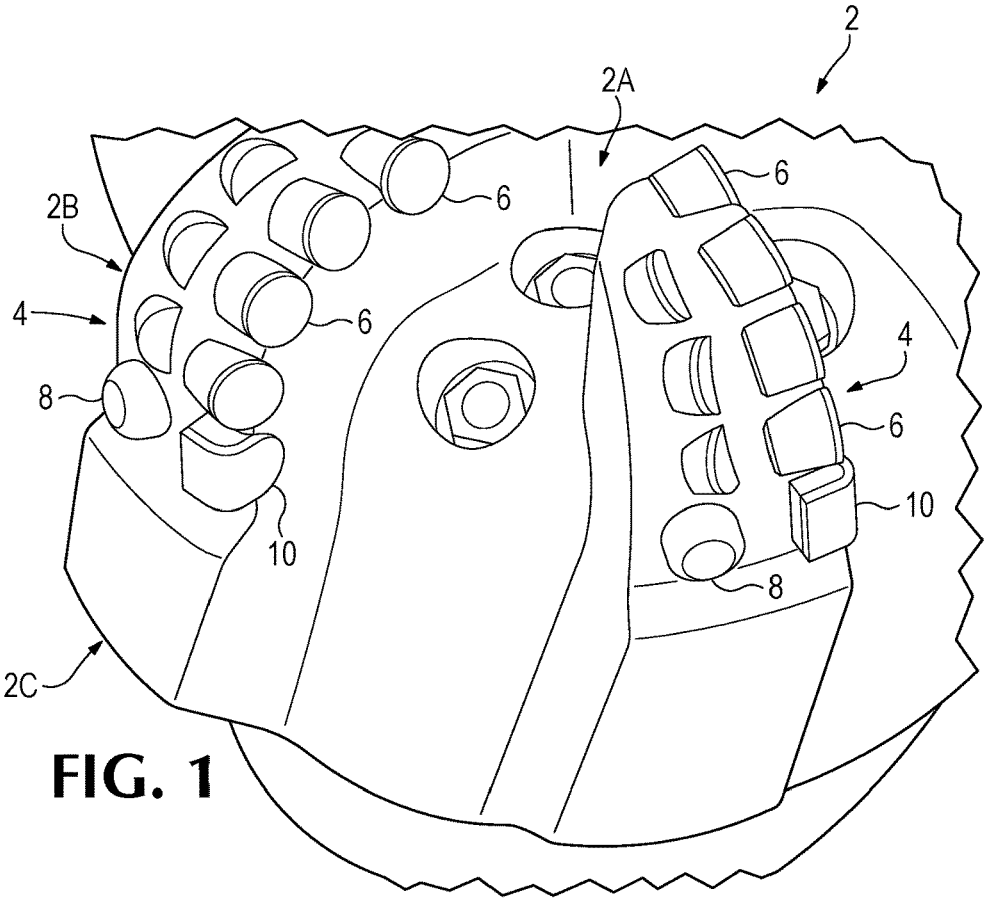
FIG. 1 is a partial perspective view of a PDC drag bit.
Figure 2:
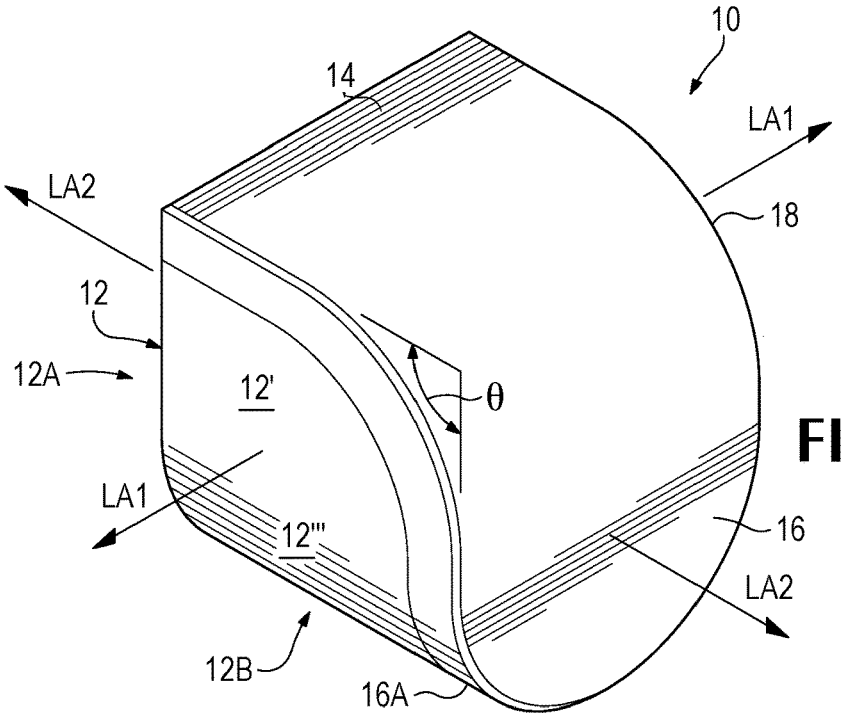
FIG. 2 is a perspective view of an inventive hybrid cutter.
Figure 3:
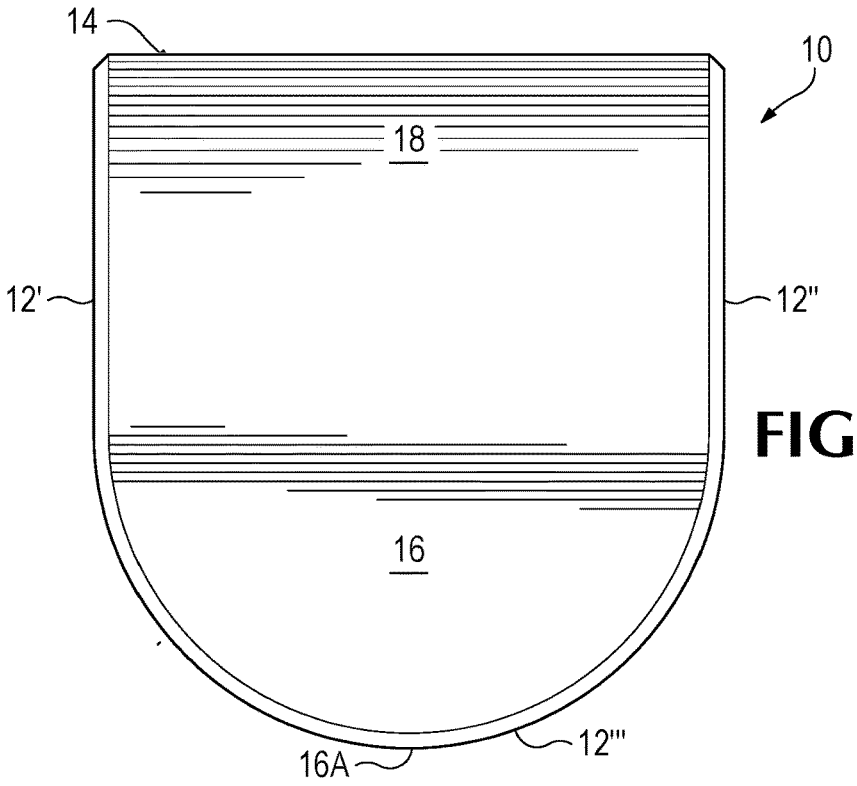
FIG. 3 is a front view of the hybrid cutter of FIG. 2.
Figure 4:
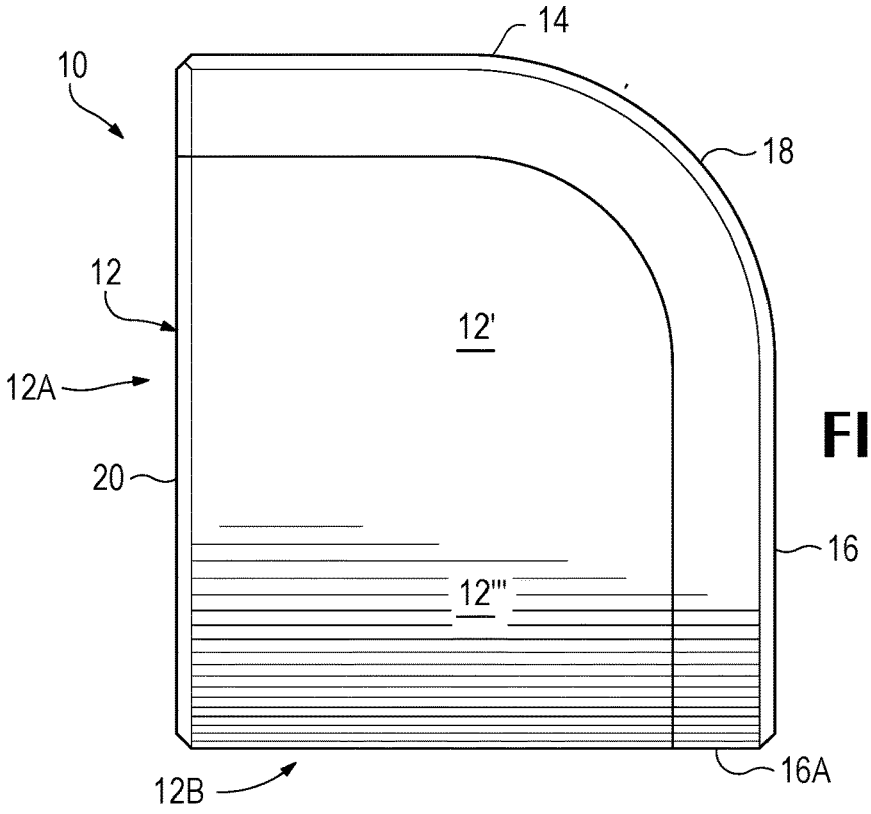
FIG. 4 is a side view of the hybrid cutter of FIG. 2.

FIG. 1 illustrates an example of a drag bit for drilling oil and gas wells with conventional cutters 6 and cutters 10 called hybrid cutters in this application. While a drag bit is used here for the purpose of illustration, the hybrid cutter 10 can be used on a variety of different downhole cutting tools such as reamers and coring bits to advantage. A drag bit is described here for the purpose of example. Cutters in accordance with this invention could be used with drag bits (or other tools) having different constructions than described below in the given example.

The drag bit is designed to be rotated around its central axis to engage earth strata and advance a borehole. The bit 2 has a bit body with a nose 2A, a shoulder portion 2B and a gage portion 2C above the shoulder portion. Blades 4 extend from the nose portion around the shoulder of the bit body. Cutters 6 are shown mounted in recesses on the leading edges of the blades 4. Additional cutters are shown mounted behind the leading edge cutters on the blade. The cutters define a cutting profile for the bit. Cutters at the nose of the bit advance the borehole failing rock as the bit rotates. Cutters at the shoulder of the bit generally widen the borehole and limit wear on the body of the bit.

Each cutter defining the cutting profile engages the earthen material of the strata and fails the rock of the borehole. Drilling fluid is pumped down the drill string and through nozzles in the bit to flush cut material from the junk slot between the blades. The flushed material then passes back up the annulus between the drill string and the borehole to the surface.

The gage portion of the drill bit is shown with tungsten carbide inserts 8 (TCI) mounted to an outward face of the blade 4. TCIs are generally rounded and make contact with the wall before the bit body contacts the wall to maintain a spaced relationship between the borehole wall and the body of the bit. The body of the bit can be steel with hardfacing or hard particles in a matrix of binding metals. The bit is subject to abrasion and erosion by contact with the borehole. While tungsten carbide is less hard than the diamond tables of the cutters, the TCIs are not intended to cut the strata layers and are not subject to the impact and stresses experienced by the cutter surfaces.

Hybrid cutters 10 are shown in FIG. 1 mounted to the leading edge of the blade forward of the TCIs. These hybrid cutters have features and function in a similar manner to both the conventional cutters and the TCIs. Hybrid cutter 10 generally shown in FIGS. 24 includes a substrate or base 12 that supports a forward or cutting surface 16 of ultrahard material, an outer or gage surface 14 of ultrahard material and a transition surface 18 of ultrahard material.

Cutter 10 can be mounted in a recess of the blade of the bit so the forward or cutting surface 16 faces generally in the direction of rotation of the bit. The forward face can engage the borehole or strata material in the drilling fluid. The outer or gage surface 14 of cutter 10 mounted in the bit faces radially towards the wall of the borehole. The outer surface 14 maintains a spacing between the borehole wall and the bit body to protect the bit from erosion. The ultrahard surfaces 14, 16 limit erosion of the cutter during operation. Other mounting orientations may also be used. The hybrid cutter could be mounted in the nose or the shoulder of the bit. The hybrid cutter can be mounted behind a primary cutter as a backup or secondary cutter. In a preferred construction, the ultrahard surfaces are polycrystalline diamond tables but they could be formed of other materials. Alternatively, the hybrid cutter can comprise a monolithic material such as tungsten carbide without an applied ultrahard face. Alternatively, the hybrid cutter could be formed of steel with a hardfacing material to contact the borehole.

Cutters 10 include a forward surface adapted to fail earthen material to advance or widen the borehole. In a preferred construction, the forward surface has a curved inner edge 16A. As discussed below, this configuration matches the base to fit within conventional recesses within the bit. The outer region of forward surface 16 blends into the transition surface 18. Outer surface 14 is shown with a generally rectangular configuration with a forward portion that blends with the transition surface 18. Nevertheless, other configurations are possible. For example, inner edge 16A could be straight or have another shape.

The forward surface and the outer surface are transverse and preferably generally orthogonal to each other. Alternatively, the outer surface can be inclined to the forward surface at angles other than right angles. For example the angle Θ can be in the inclusive range of 60 to 120 degrees but angles outside this range are possible. Preferably the angle Θ can be in the inclusive range of 70 to 110 degrees. As one example, different angles bay enable the cutting face to have a side rake angle (or back rake) while permitting the outer face to still be oriented radially. The outer and forward surfaces are generally planar, but can incorporate facets or curves.

The transition surface 18 is preferably a smooth transition that allows the hybrid cutter to engage the borehole wall with minimum drag, passing over rougher parts of the wall without dragging. The transition surface can have a radius of curvature about an axis LA1. The radius of curvature about the axis can be at least about 10% of the largest linear dimension of the cutter, but other curvature radii can be used. The curve of the transition surface can limit drag on the bit when the cutter contacts the borehole wall. Alternatively, transition surface 18 can be diminishingly small in relation to the adjacent outer and forward surfaces. The transition surface can also form a sharp corner. The transition surface could have other shapes. The transition surface could also have no ultrahard material or be only partially covered by ultrahard material. The ultrahard material of the transition surface may be a different material than the forward face or the outer face.

The substrate includes an outer portion 12A and an inner portion 12B. The outer portion 12A generally supports outer surface 14 and transition surface 18. The inner portion generally supports the forward surface 16. Sides 12', 12" of the outer portion 12A are preferably planar and parallel to each other. Sides 12', 12" are joined by a curved sidewall 12'" of inner portion 12B adjacent the forward surface 16. The curved portion can have a radius of curvature about an axis LA2 spaced from axis LA1. Alternatively, the side surfaces 12', 12" can be inclined in relation to each other. The surface 12" can be a planar surface joining side surfaces 12', 12" and adjacent the forward surface. Alternatively, the surface of substrate portion 12A and portion 12B can form a continuous curve.

The substrate back surface 20 spaced from the forward surface is preferably flat, but can take on any shape such as curved or faceted that corresponds to the recess of the bit that receives the cutter. The substrate can take on different shapes than the examples presented.

The recess in the blade that receives cutter 10 generally conforms to the outer surface of the hybrid cutter so that a thin layer of binding material between the recess surface and the substrate surface can retain the cutter in the recess. The binding material can be a brazing material, a solder or other binder. Other mounting methods may be used. In the illustrated embodiment the curve of surface 12'" matches the cylindrical shape of a standard cutter to permit installation of either a hybrid cutter or a standard cutter in some recesses.

The hybrid cutter can be manufactured in several different ways. Previously, cutters were formed by pouring raw material such as diamond in the bottom of a cylindrical mold and pouring tungsten carbide with cobalt adjacent the diamond. The mold was then processed under very high pressure and temperature to solidify and bond the materials together into a functional cutter. The present inventive cutter can be processed in a similar manner. A mold corresponding to the final shape of the hybrid cutter is partially filled with ultrahard particles. The particles can be held in place to a uniform thickness by a binder mixed with the particles, by a sacrificial partition or other method to take the form of the ultrahard faces. The mold can be filled with substrate material adjacent the particles. The filled mold is then processed under high temperature and pressure to form the final hybrid cutter.

Alternatively, the cutter can be assembled from subcomponents. Portions of the cutter can be formed as described above and then connected together to form the final cutter. For example, a first portion of the cutter can include the forward surface and a portion of the substrate processed to a final shape. Separately, the outer surface and the transition surface can be formed with another portion of the substrate to create a second portion of the cutter. The separate portions can be bonded together and mounted to the recess of the blade by brazing or soldering or other method.

The tables or ultrahard surfaces of the hybrid cutter can be comprised of, e.g., titanium nitride, boron nitride, diamond, osmium diboride, tungsten carbide or other hard material. While a high pressure and high temperature method for manufacturing diamond compacts has been used as an example, other methods and other materials for manufacturing the hybrid cutter can be used.

The hybrid cutter is economical to manufacture, does not require modification of an existing cutter and can function as both cutter and standoff.

The foregoing description is of exemplary embodiments. The invention, as defined by the claims, is not limited to the described embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated or described structures or embodiments.

The invention claimed is:

1. A cutter for a downhole cutting tool to contact a borehole wall comprising:

an ultrahard front face oriented generally in the direction of rotation of the tool;

an ultrahard outer face oriented generally in a radial direction configured for maintaining spacing between the borehole wall and a body of a bit on which the cutter will be mounted; and a base supporting the ultrahard front face and the ultrahard outer face to be received in a recess of the tool, wherein the base includes a planar face opposite to the ultrahard front face, and wherein the ultrahard outer face extends to the planar face of the base.

2. The cutter of claim 1 where the ultrahard faces are polycrystalline diamond tables.

3. The cutter of claim 1 where the base includes spaced side surfaces adjacent the ultrahard front face and the ultrahard outer face, and the side surfaces are free of an ultrahard surface.

4. The cutter of claim 1 where the ultrahard front face is planar.

5. The cutter of claim 1 where the ultrahard outer face is planar.

6. The cutter of claim 1 including an ultrahard transition surface connecting the ultrahard front face and the ultrahard outer face.

7. The cutter of claim 6 where the ultrahard transition face is curved.

8. The cutter of claim 1 where the base includes a curved face opposite the ultrahard outer face to complement the recess.

9. A cutter for a downhole cutting tool including:

a front table of polycrystalline diamond (PCD);

a gage table of PCD; and a base with a first interface to the front table and a second interface to the gage table transverse to the first interface and spaced side surfaces extending transverse and between the front table and the gage table, wherein the spaced side surfaces are generally planar.

10. The cutter of claim 9 where the front table and the gage table are oriented at an inclusive angle between 60 and 120 degrees.

11. The cutter of claim 9 including a curved inner surface connecting the spaced side surfaces, wherein the curved inner surface is opposite the gage table.

12. A cutter for a downhole cutting tool including:

a diamond table defining a first curved portion with a radius of curvature about a first axis; and a base supporting the diamond table, the base defining a second curved portion with a radius of curvature about a second axis generally perpendicular to and spaced from the first axis, wherein the base includes two spaced side faces that are generally parallel to each other and joined by the second curved portion.

13. The cutter of claim 12 where the first axis is substantially parallel to the axis of the tool when the base is received in a recess of the tool.

14. The cutter of claim 12 where the spaced side faces are generally perpendicular to the first axis.

15. The cutter of claim 12 where the radius of curvature about the first axis is at least about 10% of the largest linear dimension of the cutter.

16. A cutter for a downhole cutting tool comprising:

a front surface for cutting formation and an outer surface oriented transverse to the front surface, the outer surface being configured to contact a borehole wall so as to maintain spacing between the borehole wall and a body of a bit on which the cutter will be mounted, the front and outer surfaces each being defined by an ultrahard material; and a base underlying and supporting the front and outer surfaces, the base being defined by a material different from the front and outer surfaces.

17. The cutter of claim 16 wherein the ultrahard material is a polycrystalline diamond compact, and the base includes tungsten carbide.

18. The cutter of claim 16 including a transition surface connecting the front and outer surfaces, wherein the transition surface is defined by the ultrahard material.

19. The cutter of claim 18 wherein the transition surface is curved.

20. The cutter of claim 16 wherein the base includes a curved surface opposite the outer surface.

21. A cutter for a downhole tool comprising a cutting face, a gage face and a base supporting the cutting and gage faces, the cutting face facing generally forward and the gage face facing generally outward, and the base including a curved surface diametrically opposite the gage face for enabling it to be brazed into a pocket in the downhole tool, wherein the gage face is configured to contact a borehole wall so as to maintain spacing between the borehole wall and a body of the downhole tool on which the cutter will be mounted.

22. The cutter of claim 21 wherein the cutting and gage faces are defined by an ultrahard material.

23. The cutter of claim 22 wherein the cutting and gages faces are each generally flat.

24. The cutter of claim 21 including a curved transition surface connecting the cutting and gage faces.

25. The cutter of claim 24 wherein the cutting face, the gage face and the transition surface are defined by an ultrahard material.

26. The cutter of claim 25 wherein the curved transition surface is defined around a first axis and the curved surface of the base is defined around a second axis transverse to the first axis.

27. The cutter of claim 24 wherein the curved transition surface is defined around a first axis and the curved surface of the base is defined around a second axis transverse to the first axis.

* * * * *